US010539037B2

(12) United States Patent
Giliberti et al.

(10) Patent No.: US 10,539,037 B2
(45) Date of Patent: Jan. 21, 2020

(54) DEVICE FOR CONTROLLING CLEARANCE AT THE TOPS OF TURBINE ROTATING BLADES

(71) Applicant: Safran Aircraft Engines, Paris (FR)

(72) Inventors: Guillaume Michael Maurice Giliberti, Moissy-Cramayel (FR); Joël Creti, Moissy-Cramayel (FR); Gabrijel Radeljak, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 259 days.

(21) Appl. No.: 15/386,751

(22) Filed: Dec. 21, 2016

(65) Prior Publication Data

US 2017/0175562 A1 Jun. 22, 2017

(30) Foreign Application Priority Data

Dec. 22, 2015 (FR) ..... 15 63143

(51) Int. Cl.

| | |
|---|---|
| ***F01D 11/18*** | (2006.01) |
| ***F01D 11/12*** | (2006.01) |
| ***F01D 5/06*** | (2006.01) |
| ***F01D 5/12*** | (2006.01) |
| ***F01D 25/24*** | (2006.01) |

(52) U.S. Cl.

CPC ..... *F01D 11/18* (2013.01); *F01D 5/06* (2013.01); *F01D 5/12* (2013.01); *F01D 11/122* (2013.01); *F01D 25/24* (2013.01); *F05D 2220/32* (2013.01); *F05D 2240/307* (2013.01); *F05D 2260/12* (2013.01); *F05D 2260/232* (2013.01); *F05D 2300/173* (2013.01)

(58) Field of Classification Search

CPC ..... F01D 11/18; F01D 11/24; F05D 2240/11; F05D 2300/173; F05D 2260/12

See application file for complete search history.

(56) References Cited

U.S. PATENT DOCUMENTS

| | | | | |
|---|---|---|---|---|
| 4,317,646 | A * | 3/1982 | Steel | F01D 11/18 415/116 |
| 4,334,822 | A | 6/1982 | Rossmann | |
| 4,596,116 | A | 6/1986 | Mandet et al. | |
| 5,639,210 | A * | 6/1997 | Carpenter | F01D 11/18 415/135 |
| 6,126,389 | A | 10/2000 | Burdgick | |
| 9,447,696 | B2 * | 9/2016 | McCaffrey | F01D 11/18 |
| 9,951,643 | B2 * | 4/2018 | Duguay | F01D 11/14 |
| 2009/0269190 | A1 | 10/2009 | Wunderlich et al. | |

(Continued)

FOREIGN PATENT DOCUMENTS

| | | |
|---|---|---|
| EP | 1 555 394 A1 | 7/2005 |
| EP | 1 717 419 A1 | 11/2006 |

(Continued)

*Primary Examiner* — Dwayne J White
*Assistant Examiner* — Jackson N Gillenwaters
(74) *Attorney, Agent, or Firm* — Blank Rome LLP

(57) ABSTRACT

A device for controlling clearance at the tops of turbine rotating blades. The device comprises shroud supporting rings, abradable ring sectors, elastic centering elements, and a shroud supporting ring sectors inserted radially to the supporting shroud, between the elastic elements and the abradable ring sectors, which are attached to said supporting shroud, which has a volume varying according to temperature, due to the action of fluid supply elements.

15 Claims, 3 Drawing Sheets

(56) References Cited

U.S. PATENT DOCUMENTS

| | | | | |
|---|---|---|---|---|
| 2013/0149098 | A1* | 6/2013 | Petty | F01D 11/005 415/1 |
| 2016/0312643 | A1* | 10/2016 | Davis | F01D 11/18 |

FOREIGN PATENT DOCUMENTS

| | | | |
|---|---|---|---|
| EP | 2 604 805 | A2 | 6/2013 |
| FR | 2 747 736 | A1 | 10/1997 |
| GB | 2 316 134 | A | 2/1998 |

* cited by examiner

DEVICE FOR CONTROLLING CLEARANCE AT THE TOPS OF TURBINE ROTATING BLADES

BACKGROUND OF THE INVENTION

1. Field of the Invention

The present invention relates to the controlling of clearance between the tops (or apices) of rotating blades and a stationary ring assembly, in a gas turbine.

2. Description of the Related Art

A gas turbine, for instance a high pressure turbine in a turbine engine, typically comprises a plurality of stationary blades alternating with a plurality of rotating blades in the passage of the hot gases exhausting the combustion chamber of the turbine engine. The rotating blades of the turbine are surrounded, on the whole periphery of the turbine, by a stationary ring assembly. Such stationary ring assembly thus defines a wall of the hot gas flow jet through the turbine blades.

In order to increase the turbine yield, minimizing the clearance between the tops of the rotating blades of the turbine and the parts of the stationary ring assembly facing these is known.

Means making it possible to vary the diameter of the stationary ring assembly have been developed for this purpose.

An example thereof can be found in document EP1555394 which provides for the air cooling of the bosses on the external annular case of said stationary ring assembly of the turbine, which has a longitudinal axis X-X. Air is injected on an external surface of the stationary ring assembly and thus causes thermal expansions or retractions of the stationary ring assembly which are able to vary the diameter thereof. <<External>> means: radially positioned outwards relative to the axis X-X. <<Radial>> means radially to the axis X-X.

Thermal expansions and retractions can be controlled according to the turbine working speed through a valve making it possible to control the flow rate and temperature of the air supplied to the ducts. The assembly consisting of the ducts and the valve thus forms a box for controlling the clearance at the tops of the blades.

Besides, the document FR 2 747 736 discloses an assembly comprising:

- a gas turbine comprising an external annular case having a longitudinal axis X-X, and comprising rotating blades, and
- a clearance controlling device positioned facing tops of rotating blades, which specifically comprises:
  - a shroud supporting abradable ring sectors inserted radially to the shroud supporting rings, between the elastic means and the abradable ring sectors which are attached to said shroud supporting abradable ring sectors, which has a volume varying according to temperature, and
  - means for varying the temperature of the shroud supporting abradable ring sectors and thus for varying a clearance (j) at the tops of the rotating blades, radially to the shroud supporting rings.

SUMMARY OF THE INVENTION

One aim of the present invention is to provide a device for controlling the clearance at the tops of the rotating blades, as mentioned above, making it possible to vary, by thermal expansions or retractions, only, or essentially, the dimensions of a limited area at the case of the turbine, without significantly affecting the surrounding parts, for instance those of another stage. This cannot be satisfactorily obtained with the known technologies of the prior art.

The same is true for an application to a cold test bench, aiming at testing the aerodynamic performances of a HP turbine.

In this context, and in order to solve such problems, the present invention provides for:

- a gas turbine comprising an external annular case having a longitudinal axis X-X, and comprising rotating blades, and
- a clearance controlling device positioned facing a tops of rotating blades, with said clearance controlling device comprising:
  - a shroud supporting rings extending along the longitudinal axis X-X and coaxially integral with the external annular case,
  - abradable ring sectors positioned coaxially to the shroud supporting rings, so as to locally define a gas jet surrounded by the external annular case,
  - elastic means attached to the shroud supporting rings so as to center the abradable ring sectors radially to the shroud supporting rings and hold same thereon,
  - a shroud supporting abradable ring sectors inserted radially to the shroud supporting rings, between the elastic means and the abradable ring sectors which are attached to said shroud supporting abradable ring sectors, which has a volume varying according to temperature, and
  - means for varying the temperature of the shroud supporting abradable ring sectors and thus for varying the clearance j at the tops of the rotating blades, radially to the shroud supporting rings, with the assembly being characterized in that said clearance controlling device comprises, successively, in the outward direction and radially to the longitudinal axis X-X: the abradable ring sectors, the shroud supporting abradable ring sectors, the elastic means and said shroud supporting rings, so that the elastic means are radially inserted between the shroud supporting rings and the shroud supporting abradable ring sectors.

The above solution, at least when compared to FR 2 747 736, thus provides for a particular positioning of the elements of the clearance controlling device, allowing a good compactness.

Such special mounting further makes it possible to center and to hold the abradable ring sectors on the shroud supporting rings, which thus enhances compactness.

A device advantageous for local heat transfers and axially compact is thus obtained, which can be mounted on a single stage of the turbine of a turbine engine or of a test bench, without affecting the adjacent stages of the turbine.

The device in document FR 2 747 736 does not enable such compactness. As can be seen in FIG. 2 of the document, such device comprises a flexible element (equivalent to the above-mentioned elastic means) which extends axially, and is detrimental to compactness. The turbine then must have large enough axial dimensions so that the device can be accommodated on one or more stage(s). The expected compactness is not obtained.

The clearance controlling device, which is the object of the present invention, will advantageously further comprise flanges positioned side by side, parallel to the axis X-X of the support case and between which said elastic means will be positioned.

Improved radial guiding is expected therefrom.

Advantageously again, the supporting shroud will have a coefficient of thermal expansion above $10 \cdot 10^{-6}$ K−1, and preferably above $25 \cdot 10^{-6}$ K−1, at 20° C.

Such supporting shroud may specifically be aluminium-based.

With such a supporting shroud with a high expansion coefficient, a large working range will be obtained in spite of a limited environment, or even a low temperature gradient in an application to a cold test bench where a difference in temperature between the gas jet and the supporting shroud might be 150° C. only, as compared to 500° C. and above, as may be the case in an application to hot engines.

With a view to reaching compactness and a reliable and inexpensive solution, the elastic means may comprise sectorized compression strips, such as springs, positioned side by side, parallel to said longitudinal axis of the ring-supporting case.

A (hot or cold) thermal regulation will thus be obtained because of the layer of radial air circulating between the supporting shroud and the supporting case, where the strips extend and can thus act as springs. The low thermal impact expected outside the device will thus be favoured.

As regards the (hot or cold) thermal gain to be provided to the supporting shroud, it is provided for the above-mentioned means aiming at varying the temperature in the abradable ring sectors to comprise ducts supplying such shroud with a coolant fluid or a refrigerant fluid.

In order to accurately focus on the supporting shroud the thermal expansion (or retraction) imparted thereon, the supply ducts going through the ring-supporting case will advantageously be heat insulated up to the supporting shroud, in order to focus the variation in temperature onto the shroud.

On this matter, it may also be provided, more generally, that said means for varying the temperature of the shroud supporting abradable ring sectors should be thermally insulated outside the supporting shroud (as in the example above), or exclusively positioned in said supporting shroud.

With electric resistors in the supporting shroud only, the latter only (almost) could be heated, without significantly affecting the temperature of the surrounding parts.

As an application to a cold bench (jet temperature of the order of 100 to 150° C.) of the technique presented here is aimed at, the invention can then naturally relate to an assembly, as mentioned above, with all or part of the mentioned characteristics thereof, wherein the gas turbine is a high pressure gas turbine for a cold test bench specifically comprising the above-mentioned external annular case.

Besides, as the implementation of the technique of the document EP1555394 on an at least two-stage turbine is delicate, the invention provides that the high pressure gas turbine which this assembly will be applied to should comprise a first stage and a second stage after the first one, along said longitudinal axis X-X of the external annular case, with a clearance controlling device being present on the first one of such two stages only.

BRIEF DESCRIPTION OF THE DRAWINGS

The invention will be better understood, if need be, and other details, characteristics and advantages of the invention will appear upon reading the following description given by way of a non restrictive example while referring to the appended drawings wherein.

DETAILED DESCRIPTION OF THE PREFERRED EMBODIMENTS

Figure 1:
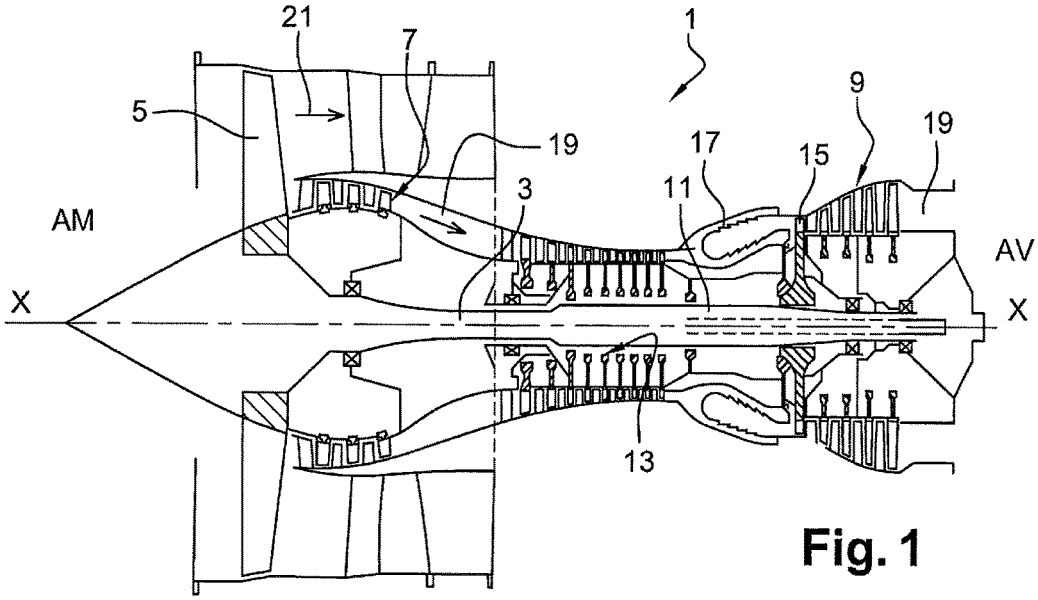
FIG. 1 is a view in longitudinal section of a twin spool turbofan engine.

FIG. 1 thus schematically shows a twin spool turbofan engine 1, with the various main components thereof. It comprises a first shaft 3 connecting, on the left of the figure, a fan rotor 5 and the first stages 7 of the compressor to the low pressure turbine 9; this assembly forms the low pressure cylinder BP. A second shaft 11, coaxial with the first shaft, along the longitudinal axis X-X, connects the high pressure stages 13 of the compressor to the high pressure turbine 15; the assembly forms the high pressure cylinder HP, with the combustion chamber 17.

In operation, approximately along the axis X-X and from upstream (AM) to downstream (AV) direction, the engine sucks air through the blower which compresses it into a main exhaust flow, in the main jet 19, which goes through the compression stages, the combustion chamber and the turbine stages and a secondary exhaust flow 21 which is ejected to the atmosphere but bypasses the combustion chamber. The turbines drive the compression means using the BP and HP shafts, respectively.

Figure 2:
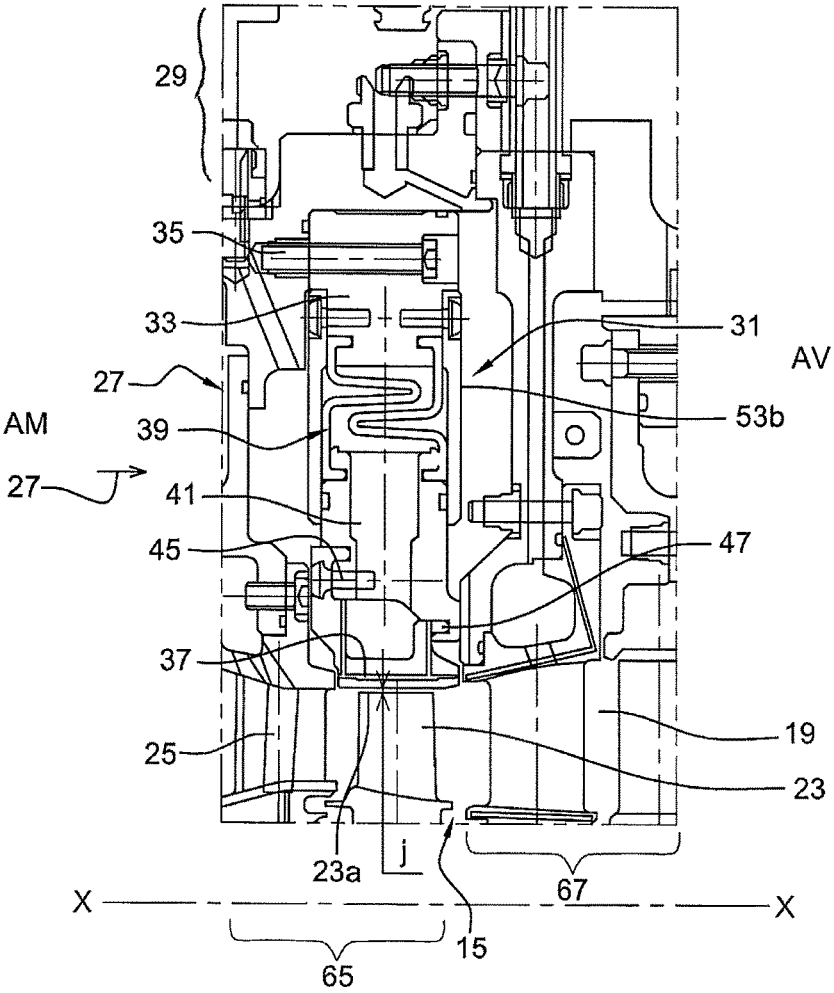
FIG. 2 is a local view in longitudinal section of a high pressure turbine area provided with a clearance controlling device according to the invention.

FIG. 2 shows a high pressure turbine 15, and it should be noted that the present invention could also apply to a low pressure turbine of a turbine engine or any other gas turbine equipped with a device controlling/checking clearance at the tops of the blades.

The high pressure turbine 15 more particularly comprises a plurality of mobile fan blades 23 positioned on the periphery about the longitudinal axis X-X, in the gas flow jet 19. Such mobile fan blades 23 are positioned downstream of stationary fan blades 25 of the turbine relative to the direction of the flow 27 of gas in the jet 19.

About the axis X-X, the mobile fan blades 23 are surrounded by an external annular case 29 of the turbine, centered on the axis X-X.

A device 31 integral with the external case 29 makes it possible to control the radial clearance j between the tops 23*a* of the mobile fan blades 23 and of the sectors 37 of the abradable rings. The device 31 comprises:

- a shroud 33 supporting rings attached by screws such as 35, to the external case 29, so as to be positioned coaxially thereto (axis X-X),
- the abradable ring sectors 37, which are positioned on the periphery about the axis X-X, coaxially to the shroud 33 supporting rings, so as to locally define a part of the gas jet 19,
- elastic means 39,
- a shroud 41 supporting the ring sectors 37 and inserted radially to the supporting shroud 33 between the elastic means 39 and the ring sectors 37,
- and means 43 (FIGS. 3 and 5) provided to vary the temperature of the shroud 41 supporting the ring sectors 37 and thus vary the radial clearance j at the top of a rotating blade 23 (refer to FIG. 2).

The shroud 33 supporting rings is thus stationary relative to the engine structure, defined here by the external case 29.

The elastic means 39 may be spring means.

These are attached to the shroud 33 supporting rings and to the shroud 41 supporting the ring sectors 37, for instance by means of local clamping, using two centering pins for each elastic sector or spring, at each end, as shown, thus providing an efficient tangential blocking. Such elastic means 39 aim at centering the shroud 41 supporting the ring sectors 37 and thus the ring sectors 37, radially to the shroud 33 supporting rings and at holding such ring sectors thereon.

The ring sectors 37 are further attached to the supporting shroud 41, for instance using screws at 45, parallel to the axis X-X and clamping at 47.

As the ring sectors 37 being in direct contact with the jet 19 gas, an abradable material 49 covers the radially internal surface thereof, so as to form a circular and continuous surface.

And, as mentioned above, the supporting shroud 41 has a volume which varies according to temperature, because of the material it is made of, and because of the impact of the means 43 thereon.

Figure 3:
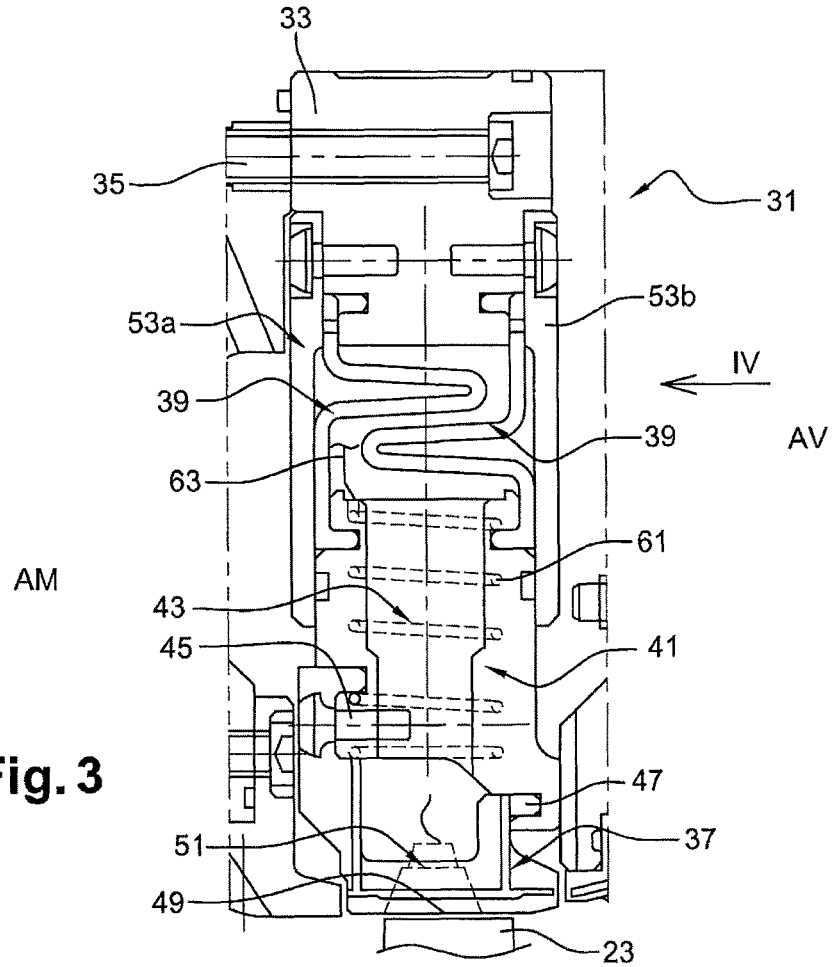
FIG. 3 is an enlarged local view of the section of FIG. 2.
Figure 4:
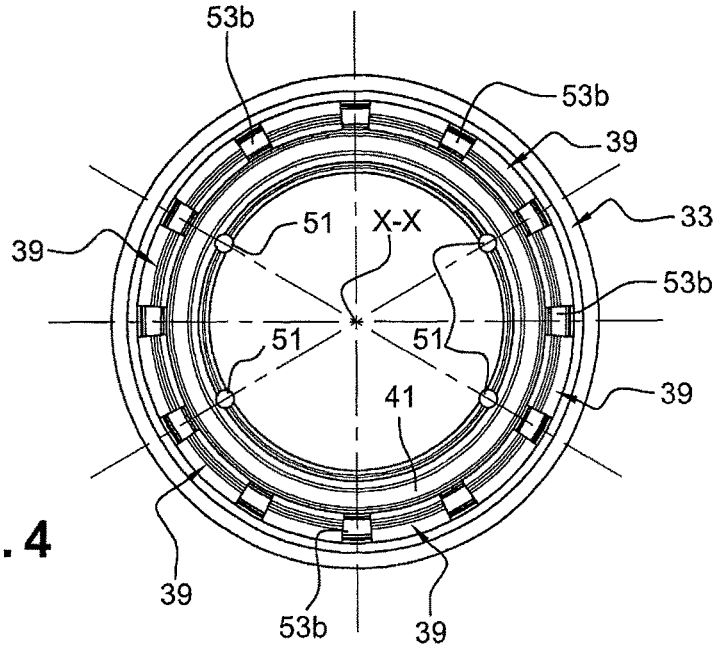
FIG. 4 is an axial view along the IV arrow of FIG. 3 (from downstream AV), completed by symmetry.
Figure 5:
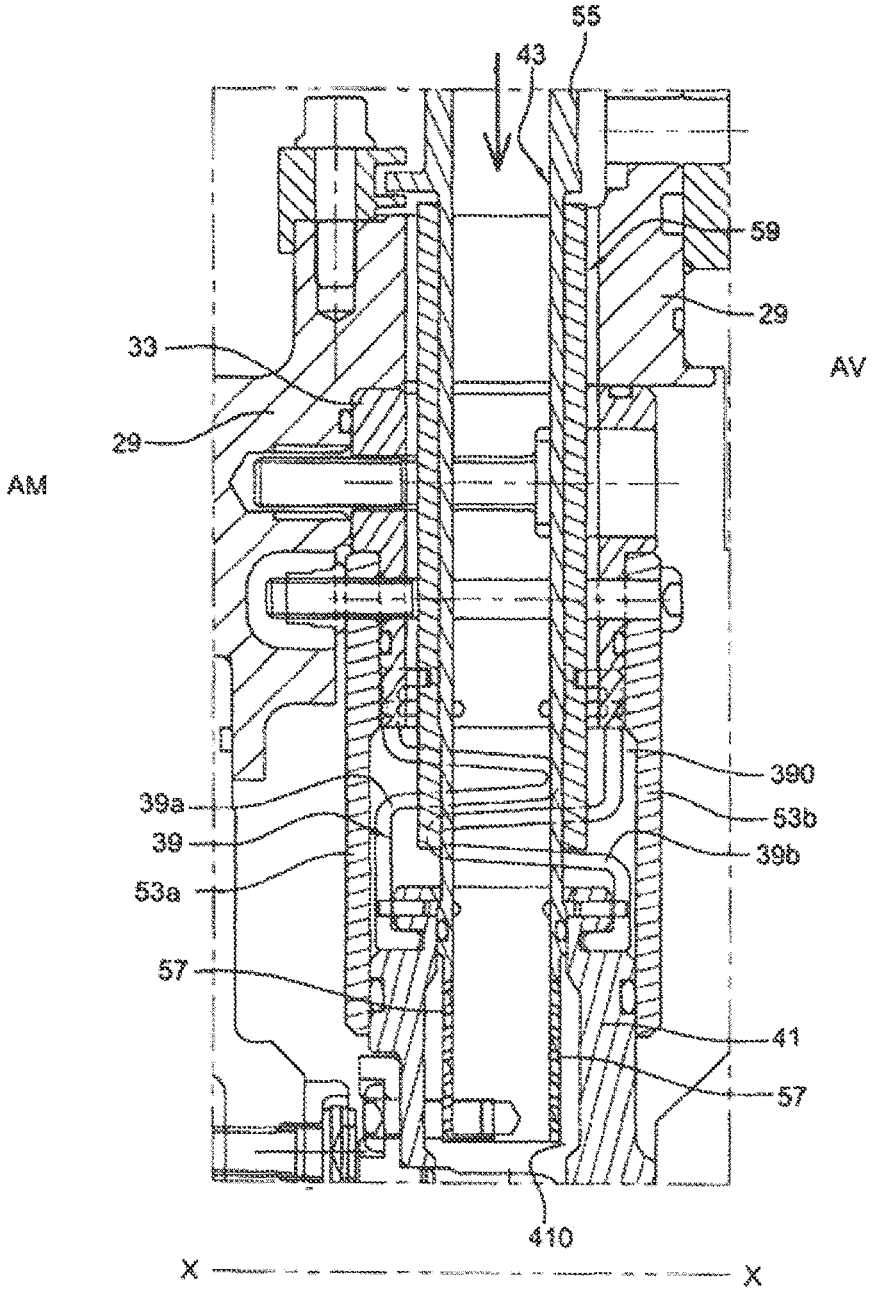
FIG. 5 shows a sectional view of another possible embodiment of the device of the invention, as FIG. 3 does.

For maximum efficiency and compactness, the above-mentioned solution illustrated in FIGS. 2, 3, 5 provides that the above-mentioned means of the device 31 will be so positioned that the following elements will be provided successively in the outward direction and radially to the longitudinal axis X-X: the abradable ring sectors 37, the supporting shroud 41, the elastic means 39 and the shroud supporting rings 33. The elastic means 39 are thus radially inserted between the shroud supporting rings and the shroud 41 supporting the abradable ring sectors.

Specifically with such position, the device 31 will make it possible to minimize the radial clearance j between the internal surface of the abradable material 49 and each mobile fan blade apex 23*a*, while enabling the rotation of such blades about the axis X-X.

Depending on the selected conditions, the controlling device 31 will vary the temperature of the supporting shroud 41 which, by retraction or expansion, will act on the radial position of the ring sectors 37, which will reduce or increase the internal diameter of the segments made of abradable material 49 and thus the clearances j at the blades tops.

Sensors 51 positioned on some ring sectors 37, may be at regular intervals on the periphery, may enable to measure the corresponding clearances j.

To supply the supporting shroud 41 with the heat or the cold required for obtaining the expected retraction or expansion effect, the embodiment illustrated in FIG. 5 provides for the means 43 to comprise ducts 55 supplying such shroud with a coolant or a refrigerant fluid. Outside the area concerned, such ducts 55 are thus connected to a suitable source of fluid.

Each duct 55 will advantageously go through the concerned shroud 33, then between two (elastic) means 39 adjacent on the periphery, and will then extend into a hollow internal volume 410 of the shroud 41 where it will supply the (hot or cold) fluid, inside the shroud itself, and preferably there only. The ducts 55 may be radial and through holes 57 may enable a lateral diffusion of the fluid into the volume 410 of the shroud.

Besides, to obtain a good radial guiding, the embodiment shown provides for respectively upstream 53*a* (not shown in FIG. 2) and downstream 53*b* flanges, positioned side by side, parallel to the axis X-X, and between which the elastic means are provided. The flanges may, each, be attached on either side of the supporting shroud 33.

Again for compactness and efficient and elastic guiding purposes, the elastic means will advantageously comprise two sectorized compression strips, such as springs, respectively upstream 39*a* and downstream 39*b* ones (39*a* and 39*b* appear in FIG. 5 only), positioned side by side, parallel to the axis X-X; refer to FIG. 5.

Such compression strips may each be Z-shaped, and shall be radially mounted between the annular shroud 41 and the rings-supporting case 33. These may be spring sheets.

It shall be understood that one aim of the invention is to focus the thermal effect onto the supporting shroud 41.

Such preferably axisymmetric part is the muscle of the device. The variation in the temperature thereof will make it possible to vary the clearance j at the top of the blade. The part shall then advantageously be aluminium-based.

More generally, it is recommended for such supporting shroud 41 to have a coefficient of thermal expansion above $10 \cdot 10^{-6}$ K−1, and preferably above $25 \cdot 10^{-6}$ K−1, at 20° C. (thus with a high coefficient of thermal expansion) which will make it possible to have a large working range, despite a limited environment, or even a low temperature gradient (150° C. is possible) if the application to a high pressure gas turbine for a cold test bench is desired.

The local concentration of the thermal effect may further involve:

- the thermal insulation of the heating or cooling means 43, out of the supporting shroud 41, as in the example shown in FIG. 5,
- or the positioning of such means 43 exclusively inside said supporting shroud 41, as in the example shown in FIG. 3.

One embodiment illustrated in FIG. 5 thus provides that the ducts 55 supplying the shroud 41 with fluid should be heat insulated, through the thermal protection 59, up to the supporting shroud. In the solution shown, the thermal protection 59 extends about the considered duct 55, through the external case 29, the supporting shroud 33 and into the intermediate space 390 where the elastic means 39 are positioned.

In the alternative solution shown in FIG. 3, the means 43 comprise an electric resistor 61 which exclusively extends into the thickness of the supporting shroud 41 and is electrically powered by a cable 63 connected to a suitable source of energy.

It should be understood that, in this case, heating the supporting shroud 41 is possible, only.

As mentioned above, the solutions provided above will more particularly make it possible to test the evolution of clearance(s) <<j>> on a high pressure gas turbine for a cold test bench.

As a matter of fact, such solutions enable:

- a low blades/shroud temperature gradient relative to the clearance j variation range which may typically be 0.5 to 1 mm radially, with a jet 19 temperature of the order of 200 to 500° C.,
- a dimensionally limited environment, and thus the possibility to test small size turbines,
- clearance j variation on one turbine stage only, without any significant thermal impact of the existing environment,
- a variation of clearance in operation.

Among the advantages offered by the above solutions, it should also be noted that:

- the combination of sectorized parts 37 with an axisymmetric shroud 41 which, because it is annular, enables the favourable distribution thereinside of the thermal flux it receives, the use of a shroud 41 made of aluminium or an equivalent, which provides a large working range despite the low temperature gradient, and the possible application of the invention to a multistage turbine, specifically a HP turbine.

As regards this last point, FIG. 2 shows that the high pressure gas turbine 15 at issue comprises a first stage 65 extended by a second stage 67 along the axis X-X with the clearance j controlling device 31 being present facing the first stage 65 only (radially outside thereof). The clearance controlling device 31 thus may be mounted stage by stage: it may be provided on one stage and not on the other one, if so desired.

The invention claimed is:

1. An assembly comprising:

a gas turbine comprising an external annular case having a longitudinal axis, and comprising rotating blades, and a clearance controlling device positioned topfacing a top of the rotating blades, with said clearance controlling device comprising:

a shroud supporting rings extending along the longitudinal axis and coaxially integral with the external annular case, abradable ring sectors positioned coaxially to the shroud supporting rings so as to locally define a gas jet surrounded by the external annular case, elastic means attached to the shroud supporting rings so as to center the abradable ring sectors radially to the shroud supporting rings and hold same thereon, a shroud supporting abradable ring sectors inserted radially to the shroud supporting rings, between the elastic means and the abradable ring sectors which are attached to said shroud supporting abradable ring sectors, which has a volume varying according to temperature, and means for varying the temperature of the shroud supporting abradable ring sectors and thus for varying the clearance at the tops of the rotating blades, radially to the shroud supporting rings, wherein said clearance controlling device comprises, successively, in the outward direction and radially to the longitudinal axis: the abradable ring sectors, the shroud supporting abradable ring sectors, the elastic means and said shroud supporting rings, so that the elastic means are radially inserted between the shroud supporting rings and the shroud supporting abradable ring sectors, and wherein the means for varying the temperature of the shroud supporting abradable ring sectors are thermally insulated in their expansions out of the shroud supporting abradable ring sectors or exclusively positioned in said supporting shroud so as to focus onto said shroud supporting abradable ring sectors the thermal expansion they impart thereon.

2. The assembly according to claim 1, wherein the clearance controlling device further comprises flanges arranged parallel to the longitudinal axis of the shroud supporting rings and between which the elastic means are positioned.

3. The assembly according to claim 1, wherein the shroud supporting abradable ring sectors has a coefficient of thermal expansion above $10.10^{-6}$ K−1, at 20° C.

4. The assembly according to claim 1, wherein the shroud supporting abradable ring sectors is aluminium-based.

5. The assembly according to claim 1, wherein the elastic means comprise sectorized compression strips positioned parallel to the longitudinal axis of the shroud supporting rings.

6. An assembly according to claim 1, wherein the means for varying the temperature of the shroud supporting abradable ring sectors comprise ducts supplying the shroud supporting abradable ring sectors with a coolant fluid or a refrigerant fluid.

7. An assembly according to claim 6, wherein the supply ducts go through the shroud supporting rings and are heat-insulated up to the shroud supporting abradable ring sectors so as to focus the variation in temperature onto said shroud supporting abradable ring sectors.

8. An assembly according to claim 1, wherein the gas turbine is a high pressure gas turbine for a cold test bench.

9. An assembly according to claim 8, wherein the high pressure gas turbine comprises a first stage extended by a second stage along the longitudinal axis of the external annular case, with the clearance controlling device being present on the first one of the two stages only.

10. An assembly comprising:

a gas turbine comprising an external annular case having a longitudinal axis, and comprising rotating blades, and a clearance controlling device positioned top acing a top of the rotating blades, with said clearance controlling device comprising:

a shroud supporting rings extending along the longitudinal axis and coaxially integral with the external annular case, abradable ring sectors positioned coaxially to the shroud supporting rings so as to locally define a gas jet surrounded by the external annular case, elastic elements attached to the shroud supporting rings so as to center the abradable ring sectors radially to the shroud supporting rings and hold same thereon, a shroud supporting abradable ring sectors inserted radially to the shroud supporting rings, between the elastic elements and the abradable ring sectors which are attached to said shroud supporting abradable ring sectors, which has a volume varying according to temperature, and elements for varying the temperature of the shroud supporting abradable ring sectors and thus for varying the clearance at the tops of the rotating blades, radially to the shroud supporting rings, wherein said clearance controlling device comprises, successively, in the outward direction and radially to the longitudinal axis: the abradable ring sectors, the shroud supporting abradable ring sectors, the elastic elements and said shroud supporting rings, so that the elastic elements are radially inserted between the shroud supporting rings and the shroud supporting abradable ring sectors, and wherein the shroud supporting abradable ring sectors is aluminium-based.

11. The assembly according to claim 10, wherein the elastic elements comprise sectorized compression strips positioned parallel to the longitudinal axis of the shroud supporting rings.

12. An assembly comprising:

a gas turbine comprising an external aim case having a longitudinal axis, and comprising rotating blades, and a clearance controlling device positioned topfacing a top of the rotating blades, with said clearance controlling device comprising:

a shroud supporting rings extending along the longitudinal axis and coa y integral with the external annular case, abradable ring sectors positioned coaxially to the shroud supporting rings so as to locally define a gas jet surrounded by the external annular case, elastic elements attached to the shroud supporting rings so as to center the abradable ring sectors radially to the shroud supporting rings and hold same thereon, a shroud supporting abradable ring sectors inserted radially to the shroud supporting rings, between the elastic elements and the abradable ring sectors which are attached to said shroud supporting abradable ring sectors, which has a volume varying according to temperature, and elements for varying the temperature of the shroud supporting abradable ring sectors and thus for varying the clearance at the tops of the rotating blades, radially to the shroud supporting rings, wherein the elements for varying the temperature of the shroud supporting abradable ring sectors comprise ducts supplying the shroud supporting abradable ring sectors with a coolant fluid or a refrigerant fluid, wherein said clearance controlling device comprises, successively, in the outward direction and radially to the longitudinal axis: the abradable ring sectors, the shroud supporting abradable ring sectors, the elastic elements and said shroud supporting rings, so that the elastic elements are radially inserted between the shroud supporting rings and the shroud supporting abradable ring sectors, and wherein the supply ducts are heat-insulated up to the shroud supporting abradable ring sectors so as to focus the variation in temperature onto said shroud supporting abradable ring sectors.

13. The assembly according to claim 12, wherein the elastic elements comprise sectorized compression strips positioned parallel to the longitudinal axis of the shroud supporting rings.

14. The assembly according to claim 12, wherein the supply ducts pass through the shroud supporting rings.

15. The assembly according to claim 1, wherein the shroud supporting abradable ring sectors has a coefficient of thermal expansion above $25.10^{-6}K-1$, at 20° C.

* * * * *